US005648803A

United States Patent [19]

Koyama et al.

[11] Patent Number: 5,648,803

[45] Date of Patent: Jul. 15, 1997

[54] INK JET RECORDER CAPABLE OF RELIABLY SEALING INK JET NOZZLE

[75] Inventors: Kazuya Koyama; Norihiro Ochi; Kohji Tsurui; Hisashi Yoshimura, all of Nara, Japan

[73] Assignee: Sharp Kabushiki Kaisha, Osaka, Japan

[21] Appl. No.: 464,561

[22] Filed: Jun. 5, 1995

[30] Foreign Application Priority Data

Jul. 28, 1994 [JP] Japan ..... 6-176596

[51] Int. Cl.[6] ..... B41J 2/165

[52] U.S. Cl. ..... 347/30

[58] Field of Search ..... 347/22, 23, 29, 347/30, 32

[56] References Cited

U.S. PATENT DOCUMENTS 4,695,851 9/1987 Terasawa ..... 347/30

5,420,619 5/1995 Glassett et al. ..... 347/30

FOREIGN PATENT DOCUMENTS 442713 8/1991 European Pat. Off. ..... 347/23

480473 4/1992 European Pat. Off. ..... 347/23

61-277456 12/1986 Japan .

5-254141 10/1993 Japan ..... 347/30

*Primary Examiner*—John E. Barlow, Jr.

[57] ABSTRACT

In a non-printing state, a cap is moved toward an ink jet nozzle of a head, for sealing the same. Immediately before the cap comes into contact with the jet nozzle, a gear is rotated by a motor to drive a piston, for sucking air from the interior of the cap by a suction pump consisting of the piston and a cylinder. This sucking operation is continued until the cap comes into close contact with the jet nozzle, for sucking the ink from the head.

11 Claims, 10 Drawing Sheets

INK JET RECORDER CAPABLE OF RELIABLY SEALING INK JET NOZZLE

BACKGROUND OF THE INVENTION

1. Field of the Invention

The present invention relates to a recorder of an ink jet system, and more particularly, it relates to an ink jet recorder having a capping device for an ink jet nozzle.

2. Description of the Background Art

In general, an ink jet recorder comprises a structure which is specific to a system of making recording by jetting ink, in addition to a structure which is directly related to the recording. When the recorder itself is not used for a long time, therefore, ink remaining in a jet nozzle or an ink chamber communicating with the jet nozzle may be thickened due to evaporation of water, leading to incapability of jetting. In order to prevent this, there are provided an ink suction method of sucking the thickened ink from the jet nozzle or the ink chamber for eliminating the same, and a capping device (sealing device) for sealing a jet nozzle surface thereby preventing evaporation of water from the ink through the jet nozzle. While a system of sealing the jet nozzle against the outside air has been employed in general, air may be forced into the ink jet nozzle when the same is capped, to cause defective jetting. In order to prevent this, an additional device is provided for making a cap communicate with the atmosphere immediately before bringing the same into contact with the ink jet surface thereby preventing forcing of air. An example of a conventional jet nozzle sealing device is now described with reference to FIGS. 9, 10 and 11, on the basis of Japanese Patent Laying-Open No. 61-277456 (1986).

Referring to FIG. 11, numeral 101 denotes recording heads, each having a storage part for ink which is supplied from an ink supply source, a passage for jetting the stored ink and an orifice provided on its forward end, and further comprising an energy converter consisting of a piezoelectric element which is one of electromechanical transducers or a heating underflow body which is one of electrothermal converters. For example, four such recording heads 101 are provided for color recording in response to ink colors, while only a single recording head is provided for monochromatic recording. These recording heads 101 are mounted on a carriage 102, which is slidable along two guide shafts 118. The recording heads 101 are connected with the carriage 102 by flexible cables 106, so that control signals for the recording heads 101 are transmitted through the flexible cables 106. The carriage 102 is fixed to an intermediate portion of an endless belt 114, which is driven by a motor 116 to reciprocate the carriage 102. Upper and lower pairs of rollers 110 and 112 are provided in parallel with the guide shafts 118 to be opposed to the carriage 102, and a recording paper P is guided to be held between the respective rollers 110 and 112. A paper feed motor 108 is fixed to an end of one of the rollers 110, for feeding the recording paper P.

On the other hand, a suction recovery device 120 is provided on a home position shown by symbol H. This suction recovery device 120 has a structure shown in FIGS. 9 and 10. The suction recovery device 120 is assembled with reference to a substrate 120*a*, and a motor 125 is fixed to a part thereof. A pinion gear 125*a* which is fixed to an output shaft of the motor 125 engages with a gear 125*b*, while another pinion gear (not shown) which is integrated with the gear 125*b* engages with another gear 125*c*. Still another pinion gear 125*d* which is fixed to a rotary shaft of the gear 125*c* engages with still another gear 124. Two trapezoidal cams 124*a* are projectingly provided on an upper surface of the gear 124 to be circumferentially separated from each other at prescribed angular spaces.

On the other hand, a pump lever 129 is pivotally supported by a support frame 129*a* which is projectingly provided on the substrate 120*a* through a shaft 129*b*, to be rotatable along its intermediate portion. An end of the pump lever 129 is provided with a roller 129*c* to be in contact with upper portions of the cams 124*a* projectingly provided on the gear 124, while another end thereof is in contact with a piston 126*a* of a pump 126 through a projection 129*d*. The piston 126*a* is regularly urged to project by a spring which is provided in the pump 126, for regularly bringing the roller 129*c* into contact with the gear 124.

A plurality of caps 122*a* to 122*d* which are made of an elastic material such as rubber are fixed to a cap holder 121. The caps 122*a* to 122*d*, which are provided with ink absorbers 137 on inner lower portions thereof respectively, are connected to the pump 126 through tubes 127*a* to 127*d* independently of each other. The cap holder 121 is slidably provided on the substrate 120*a*, and regularly pressed by a spring (not shown) to be separated from the pump 126. A gear 123 is rotatably pivotally supported on a lower side of the cap holder 121. An internal cam 123*a* is formed on an upper surface of the gear 123, so that a shaft 121*a* projecting from the lower end of the cap holder 121 is in contact with the internal cam 123*a* through a roller. Therefore, the cap holder 121 is repeatedly pushed back toward the pump 126 by a projecting portion of the cam 123*a* following rotation of the gear 123. The position of the cap holder 121 is detected by a switch 131.

On the other hand, the respective caps 122*a* to 122*d* have vent tubes 128*a* to 128*d*, in addition to the ink suction tubes 127*a* to 127*d*. End portions of the vent tubes 128*a* to 128*d* are connected to an electromagnetic valve device 132. A support frame 133 is fixed in the electromagnetic valve device 132 as shown in FIG. 10, so that the ends of the vent tubes 128*a* to 128*d* are connected to the support frame 133 in a side-by-side manner, and opened to the atmosphere. A solenoid 134 is so provided that its rod 134*a* is directed toward the support frame 133, and a valve 135 is fixed to its forward end for blocking opening ends of the vent tubes 128*a* to 128*d*. Numeral 136 denotes a return spring.

The operation of the conventional device having the aforementioned structure is now described. Every opening/closing operation is carried out during single rotation of the gear 124 from a cap open state, i.e., a recordable state with the caps 122*a* to 122*d* separated from a nozzle portion of a recording head (not shown). Namely, the gear 123 is rotated once during single rotation of the gear 124, so that substantially all caps 122*a* to 122*d* engage with the nozzle portion (are closed) during the rotation and this state is detected by the switch 131 for detecting opening/closing of the caps 122*a* to 122*d*. The caps 122*a* to 122*d* engage with the nozzle portion in such a state (ventilation state) that the opening ends of the vent tubes 127*a* to 127*d* are not blocked by the valve 135 with no operation of the solenoid 134. Then, the solenoid 134 operates to block the opening ends of the vent tubes 128*a* to 128*d*, whereby the roller 129*c* of the pump lever 129 comes into contact with the upper portion of one of the cams 124*a* by rotation of the gear 124 to rotate the pump lever 129 anticlockwise in FIG. 9, so that the pump 129 carries out a first sucking operation. Then, energization for the solenoid 134 is intercepted so that the valve 135 is retracted to provide a ventilation state. In this state, the roller 129*c* of the pump lever 129 comes into contact with the upper portion of another cam 124*a*, so that a second pump sucking operation is carried out. This is the so-called nonprocess suction, for sucking excess ink which is sucked in the caps 122*a* to 122*d* toward the pump 126 with air contained in the vent tubes 128*a* to 128*d*. During the nonprocess sucking operation, ink which is held by the ink absorbers 137 of the caps 122*a* to 122*d* and that adhering to the forward end of the nozzle are also sucked toward the pump 126. An ordinary cap opening/closing operation is automatically carried out through a timer for drying the nozzle portion and preventing sticking of dust, and executed as nonprocess suction in a ventilation state when no recording is made for a constant time.

Also in ordinary employment, the ink may be preliminarily jetted into the caps 122*a* to 122*d* when a non-recording state continues for a constant time after the power source is turned on, in order to obtain a proper ink jet state. The caps 122*a* to 122*d* stores excess volumes of ink in this case, and hence the ink may adhere to the forward end of the nozzle to result in instable jetting, or the recording paper is contaminated by excess ink dripping on the same when the caps 122*a* to 122*d* are opened. In order to prevent this, the aforementioned nonprocess suction is carried out in a ventilation state by an instruction from a control unit (not shown), to stabilize the ink jetting. The caps 122*a* to 122*d* are regularly opened/closed in a ventilation state, whereby it is possible to prevent retraction of a meniscus of the nozzle caused by increase of the air pressure in the capping operation.

In the conventional device, however, a mechanism for communication with the atmosphere such as the electromagnetic valve device 132 is provided in the suction recovery device 120 as shown in FIGS. 9 and 10 in order to open a relief valve (atmosphere communication valve) for preventing forcing of air into the ink jet nozzle when the caps 122*a* to 122*d* are brought into contact with an ink jet surface. Therefore, the conventional device is complicated in mechanical structure, and inhibited from miniaturization of the overall unit. Further, the conventional device is instable in reliability due to the complicated structure.

SUMMARY OF THE INVENTION

An object of the present invention is to provide an ink jet recorder, which can prevent ink from drying and thickening by reliably sealing an ink jet nozzle and is suitable for miniaturization.

An ink jet recorder according to an aspect of the present invention includes a recording head having a jet nozzle for jetting ink, and a sealing device for sealing the jet nozzle thereby preventing evaporation of water which is contained in the ink in the jet nozzle and an ink passage communicating with the jet nozzle. The sealing device includes a cap which is formed by an elastic body for sealing the jet nozzle, and an absorber for starting suction of the cap interior immediately before the cap comes into contact with the jet nozzle.

Due to the aforementioned structure, it is possible to reliably bring the cap into close contact with the jet nozzle while reliably preventing air from being forced into the jet nozzle of the recording head without newly adding a device for preventing forcing of air in a non-printing state or in a capping operation following forcible ink absorption. Thus, it is possible to improve reliability of the recording head, as well as to provide a miniature ink jet recorder at a low cost.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

(Embodiment 1)

A first embodiment of the present invention is now described with reference to FIGS. 1 to 3, 5 and 6.

Figure 1:
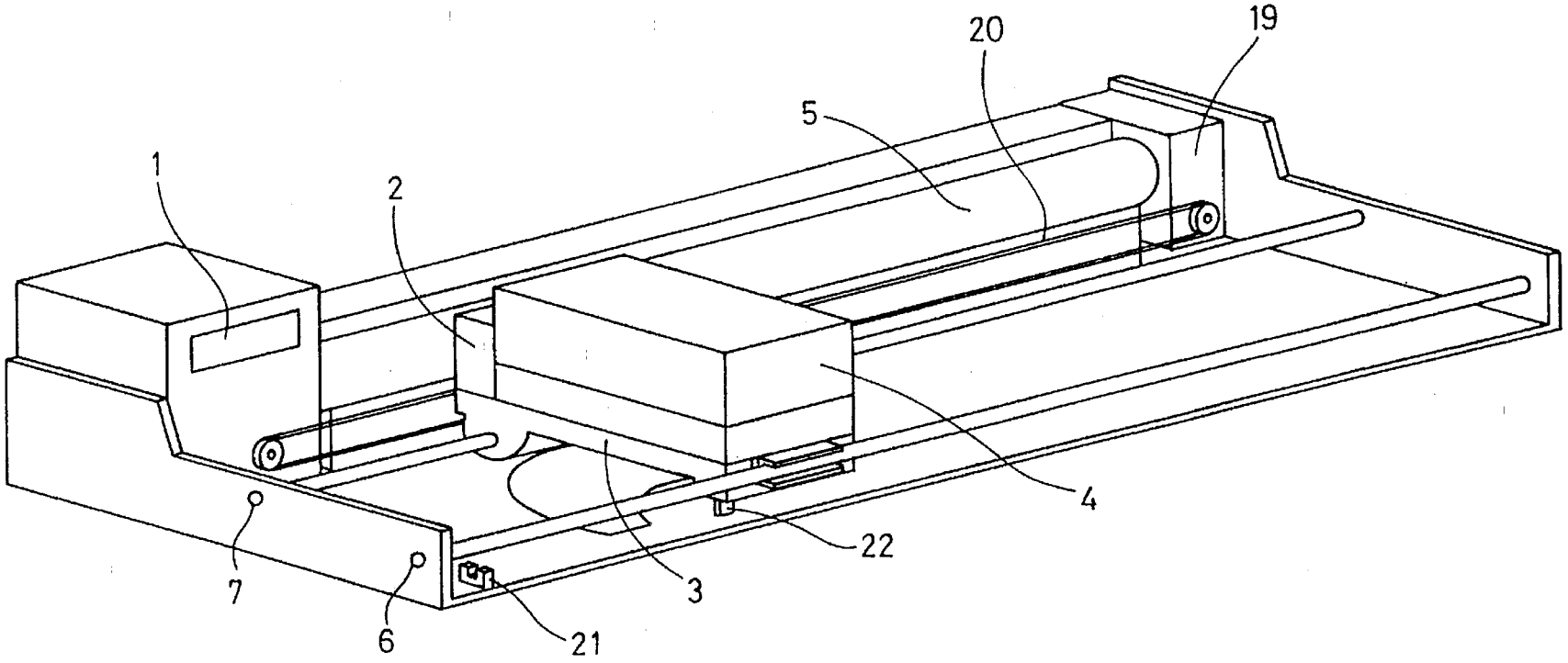
FIG. 1 is a block diagram showing a principal part of an ink jet recorder according to the present invention.

FIG. 1 is a perspective view showing the structure of a principal part of an ink jet recorder to which the present invention can be applied. Referring to FIG. 1, numeral 2 denotes a recording head for injecting ink, which is mounted on a carriage 3. Numeral 4 denotes an exchangeable ink cartridge, numeral 5 denotes a feed roller for feeding a recording paper, and numeral 1 denotes a cap, which is an essential component of the present invention, for sealing the head 2. Numeral 19 denotes a step motor for driving the carriage 3 in a scanning direction, and numeral 20 denotes a belt for transmitting driving force to the carriage 3 and moving the same in the scanning direction. Numeral 21 denotes a photosensor for detecting that the carriage 3 reaches a home position (cap position), and numeral 22 denotes a shading plate for shading the photosensor 21.

Figure 2:
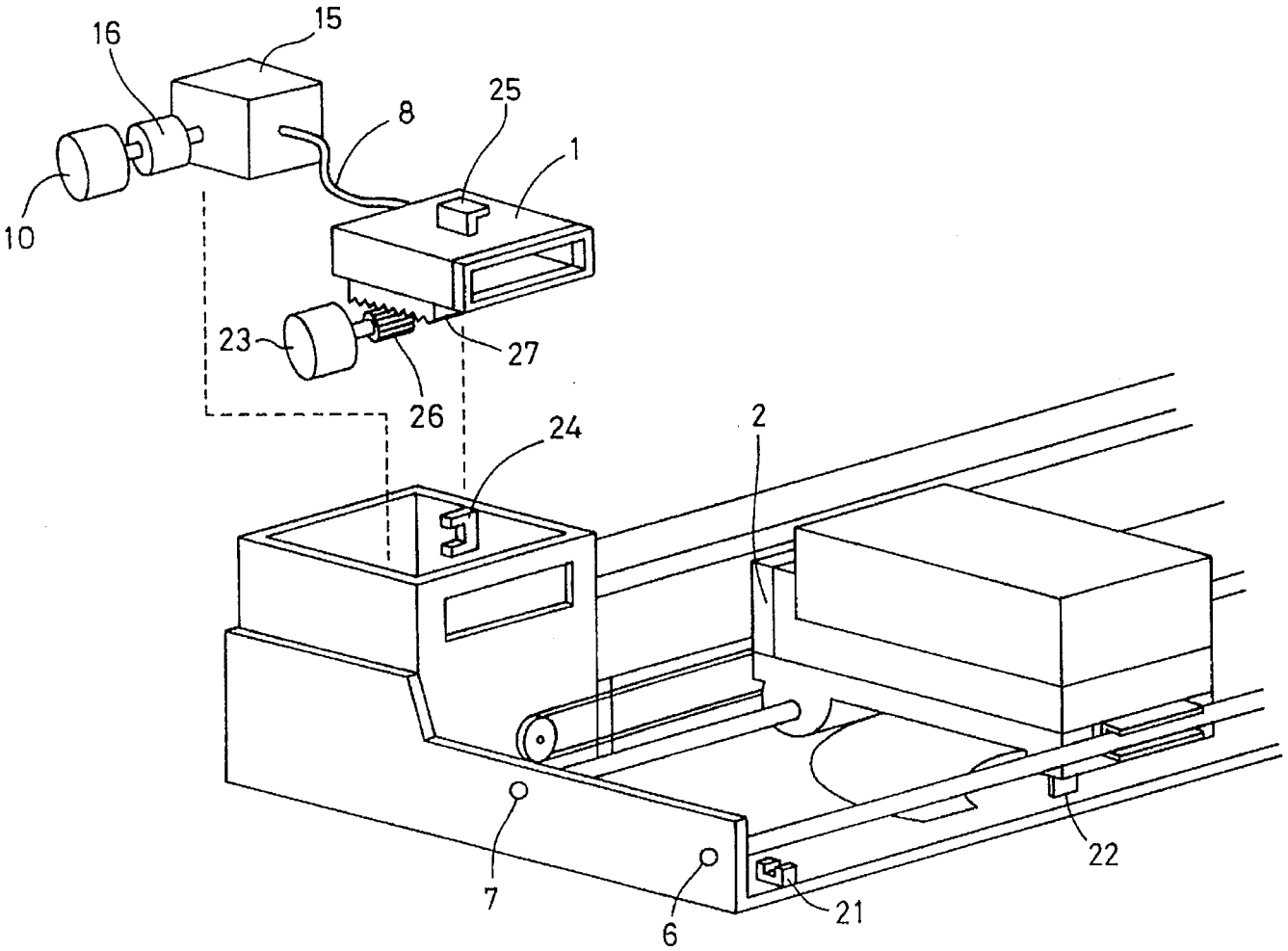
FIG. 2 is an enlarged perspective view showing a cap mechanism part.

FIG. 2 is an enlarged view showing the cap mechanism part. A portion of the cap 1 to be in contact with the head 2 is made of an elastic material such as synthetic rubber. The cap 1 is opposed to the recording head 2 on the home position (cap position), and moved toward the head 2 to be in close contact with the same, for sealing or recovering the head 2 in a non-printing state or a recovery operation for the head 2. In order to bring the cap 1 into contact with the head 2, a pinion gear 26 is rotated by a step motor 23 to engage with a rack 27 which is mounted on the cap 1, thereby moving the cap 1 toward the head 2. A photosensor 24 detects a position of the forward end of the cap 1 immediately before the same comes into contact with the head 2, and controls the step motor 23 for stopping the same at a prescribed angle of rotation, which is necessary for completely bringing the cap 1 into contact with the head 2 from the detected position. Numeral 25 denotes a shading plate for shading the photosensor 24.

Figure 3:
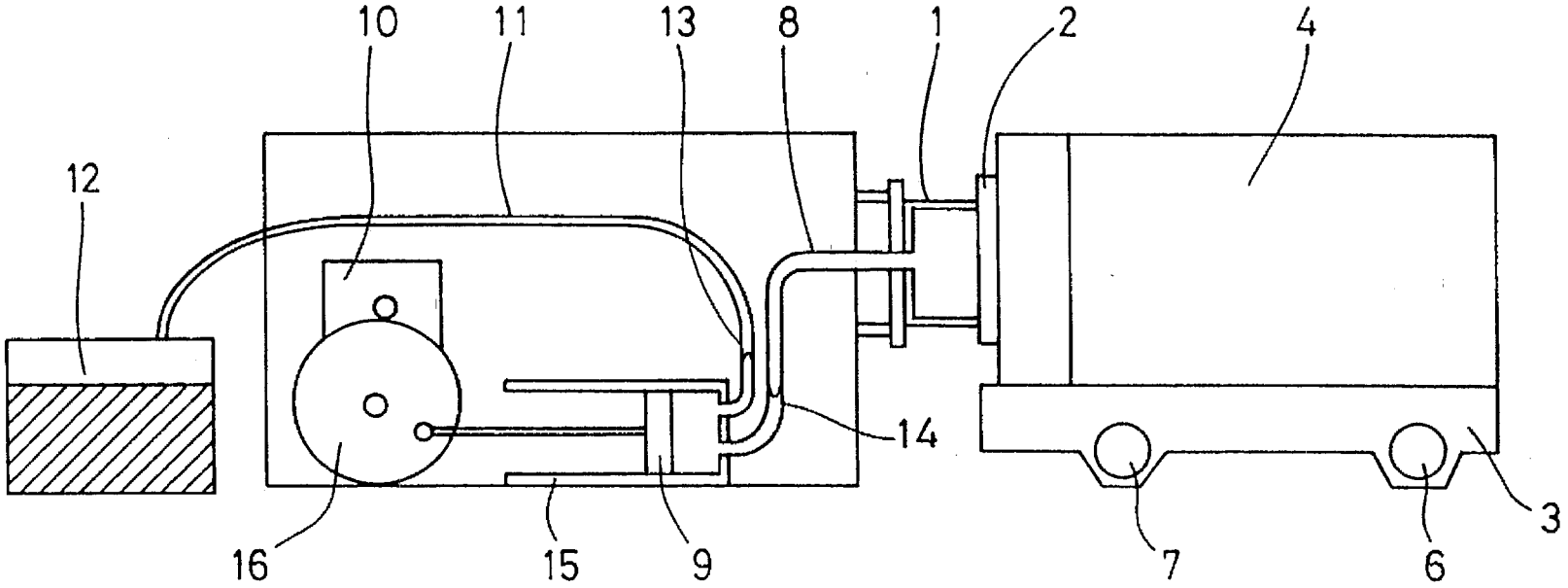
FIG. 3 is a block diagram showing a cap mechanism part in a first embodiment of the present invention.

FIG. 3 illustrates the first embodiment of the present invention. Numerals 6 and 7 denote slide shafts for guiding the carriage 3, numeral 9 denotes a piston of a suction pump for sucking the head 2, and numeral 15 denotes a cylinder. Numeral 8 denotes a suction pipe communicating with the cap 1, and numeral 14 denotes a one-way valve which is provided on an intermediate portion of the pipe 8. The piston 9 is driven by a gear 16 for changing a rotary motion of a motor, which is driven by a pump driving motor 10, to a linear motion. Numeral 11 denotes a carrier pipe for feeding ink which is sucked from the head portion by a sucking operation to a waste liquid tank 12, and numeral 13 denotes a one-way valve which is provided on an intermediate portion of the pipe 11.

Figure 5:
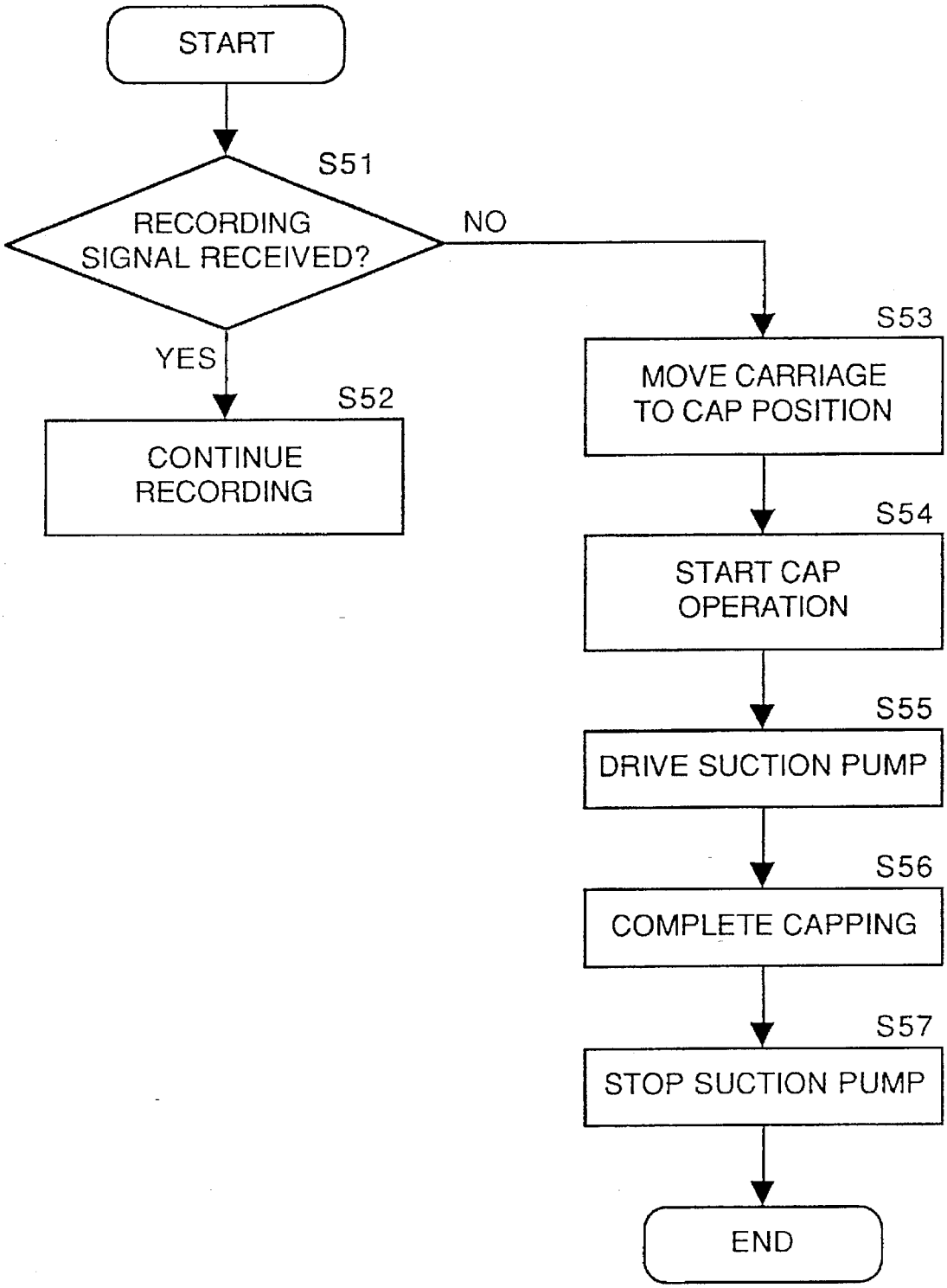
FIG. 5 is a flow chart showing an operation for capping a head in a non-printing state in the first embodiment of the present invention.
Figure 6:
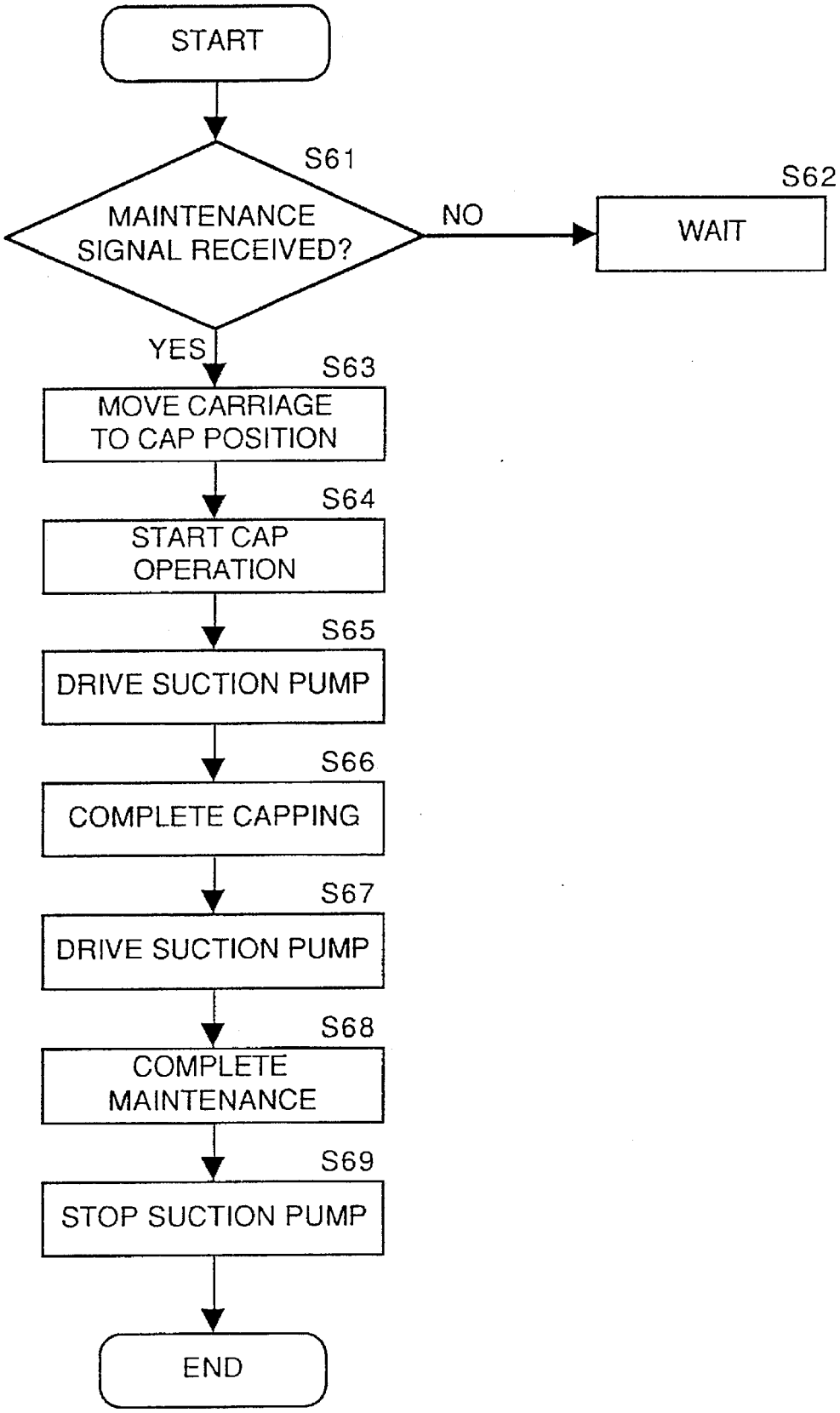
FIG. 6 is a flow chart showing an operation for carrying out recovery when a recording head is not capped in the first embodiment of the present invention.

FIGS. 5 and 6 are flow charts of an operation for capping the head 2 in a non-printing state and an operation for recovering the head 2 when the same is uncapped respectively. Referring to FIG. 5, a determination is made as to whether or not a recording signal is received (S51). If a recording signal is received, recording is continued (S52). If no recording signal is received, on the other hand, the head 2 is automatically capped. First, the carriage 3 is moved toward the cap position, which in turn is detected by the sensor 21 (S53), for starting movement of the cap 1 toward the head 2 (S54). A position of the cap 1 is detected by the sensor 24 immediately before the same comes into contact with an ink jet surface of the head 2, and the pump driving motor 10 is driven to drive the suction pump (S55). In this state, a step signal is fed to the motor 23 for bringing the cap 1 into close contact with the surface of the head 2, the angle of rotation is controlled, and capping is completed (S56). Immediately after this step, the pump driving motor 10 is stopped by driving a timer after the sensor 24 detects the position of the cap 1 immediately before the contact with the head 2 and stopping the motor 10 immediately after the contact, and suction is completed for completing an ordinary capping operation (S57).

Referring to FIG. 6, on the other hand, a determination is made as to whether or not a maintenance signal for indicating a head recovery operation is received (S61), in order to recover the head 2 when the same is uncapped. If no maintenance signal is received, the process enters a wait state (S62). If a maintenance signal is received, on the other hand, the carriage 3 is first moved to the cap position, which in turn is detected by the sensor 21 (S63), for starting movement of the cap 1 toward the head 2 (S64). A position of the cap 1 is detected by the sensor 24 immediately before the same comes into contact with the ink jet surface of the head 2, and the pump driving motor 10 is driven to drive the suction pump (S65). In this state, a step signal is fed to the motor 23 for bringing the cap 1 into close contact with the surface of the head 2, the angle of rotation is controlled, and capping is completed (S66). The pump is thereafter continuously driven for a sucking operation (S67), the pump driving motor 10 is stopped after a lapse of a constant time by driving the timer after the sensor 24 detects the position of the cap 1 immediately before the contact with the head 2 and stopping the pump driving motor 10 immediately after the contact for completing a maintenance operation (S68), and then the suction pump is stopped.

According to the ink jet recorder of the first embodiment, as hereinabove described, it is possible to reliably prevent air from being forced into the ink jet nozzle of the head and to reliably bring the cap into close contact with the ink jet surface of the head without adding a new device in a non-printing state and in a capping operation following forcible ink absorption. Thus, it is possible to miniaturize a maintenance device and the overall recorder at a low cost in high reliability.

(Embodiment 2)

A second embodiment of the present invention is now described with reference to FIGS. 4, 7 and 8.

Figure 4:
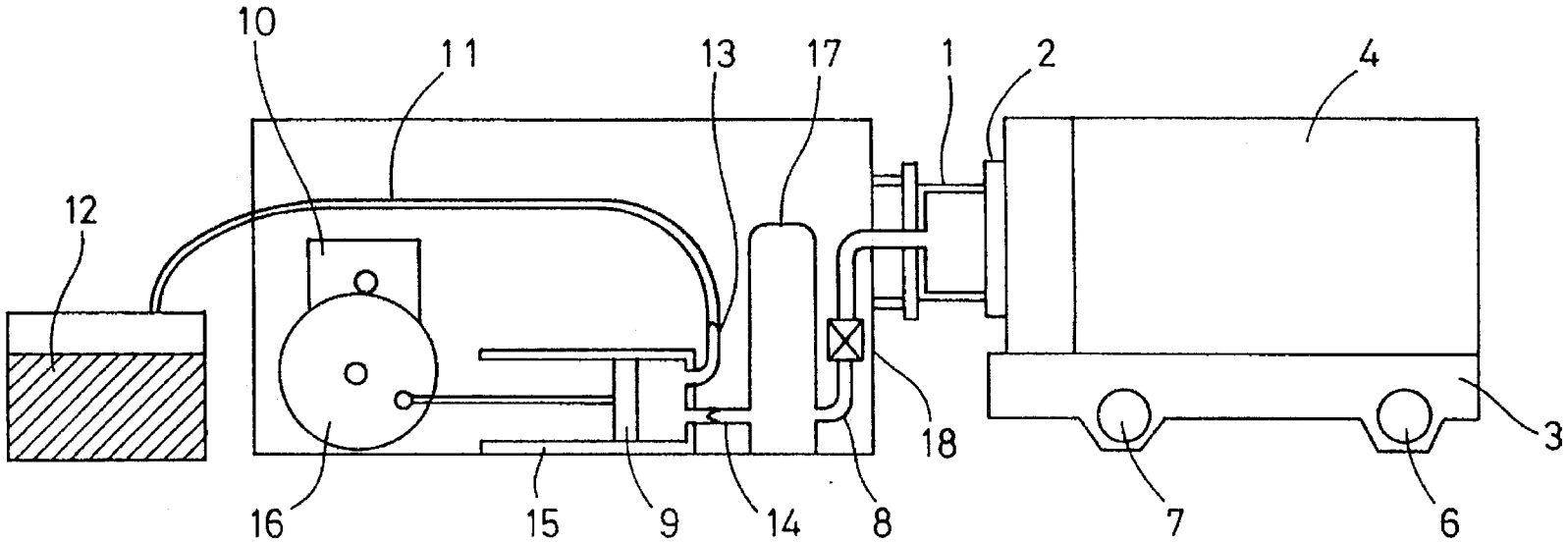
FIG. 4 is a block diagram showing a cap mechanism part in a second embodiment of the present invention.

FIG. 4 illustrates the second embodiment of the present invention. Numerals 6 and 7 denote slide shafts for guiding the carriage 3, numeral 9 denotes a piston of a suction pump for sucking the head 2, and numeral 15 denotes a cylinder. Numeral 17 denotes a negative pressure tank whose interior is regularly maintained in a negative pressure state. One portion of the negative pressure 17 communicates with the suction pump through a pipe with a one-way valve 14 which is mounted on an intermediate position thereof, while another portion of the negative pressure tank 17 communicates with the cap 1 through a pipe 8 with a valve 18 which is mounted on an intermediate position thereof. The piston 9 is driven by a gear 16 for changing a rotary motion of a motor, which is driven by a pump driving motor 10, to a linear motion. Numeral 11 denotes a carrier pipe for feeding ink which is sucked from the head 2 to a waste liquid tank 12, and numeral 13 denotes a one-way valve which is provided on an intermediate portion of the pipe 11.

Figure 7:
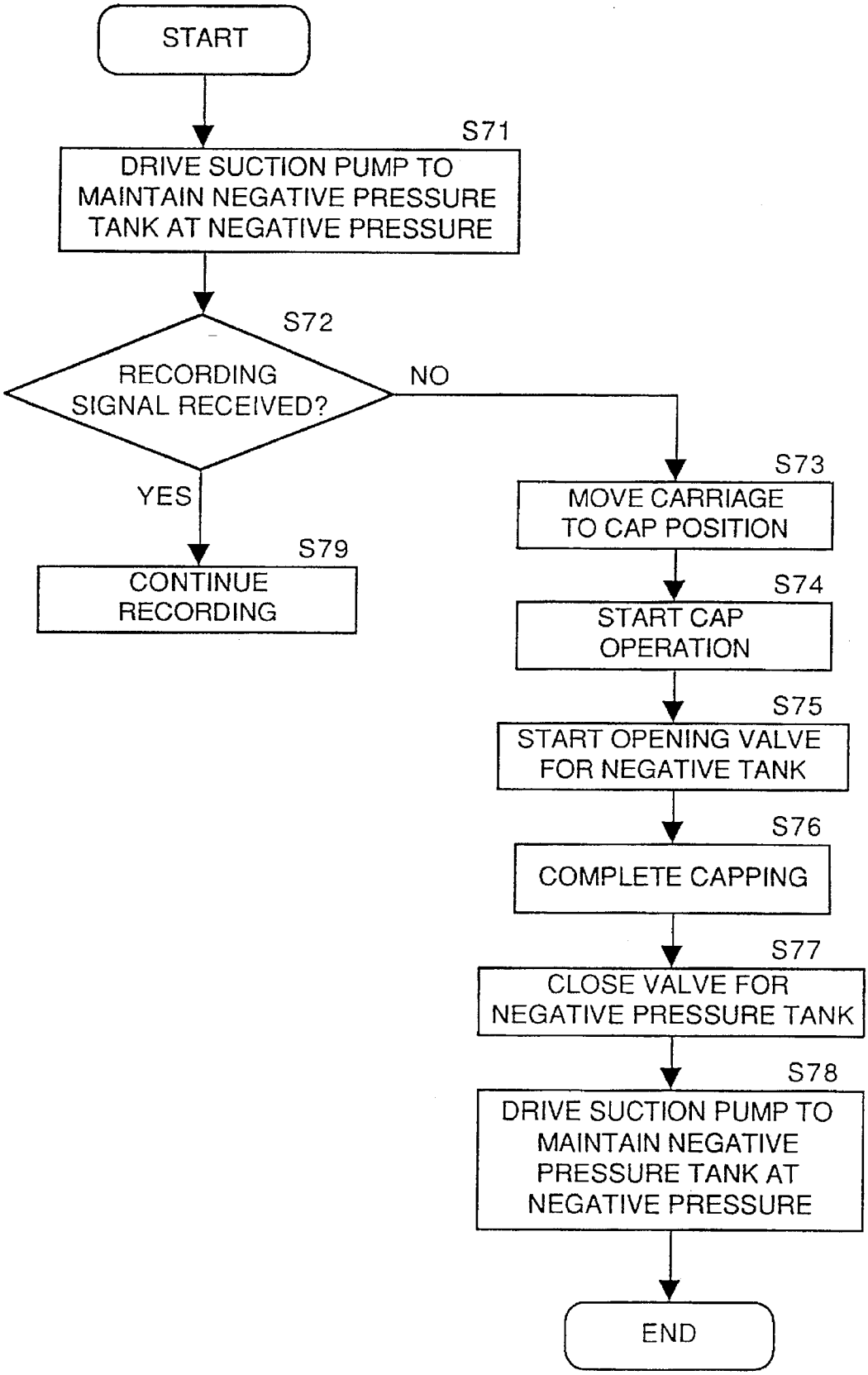
FIG. 7 is a flow chart showing an operation for capping a head in a non-printing state in the second embodiment of the present invention.
Figure 8:
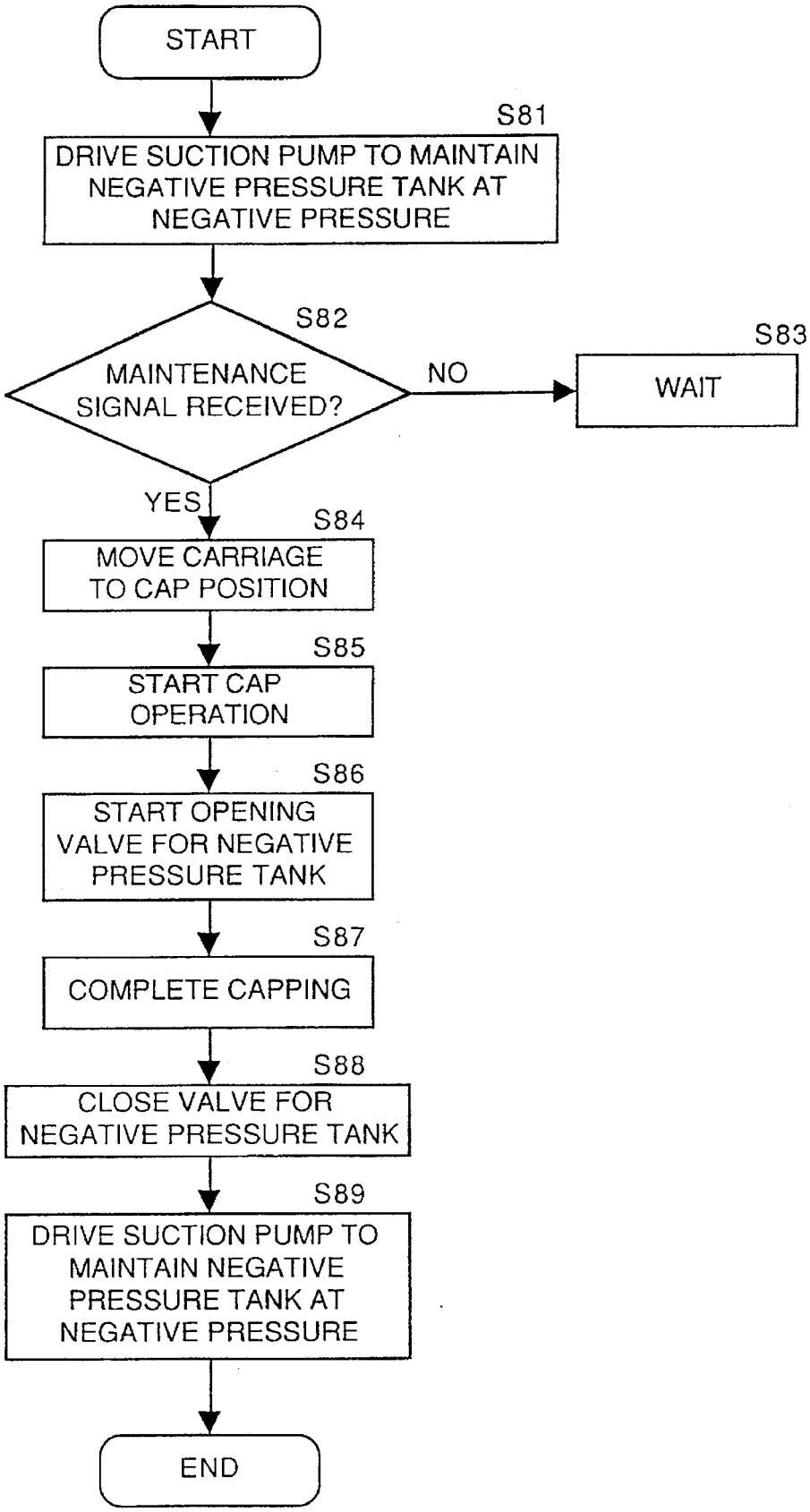
FIG. 8 is a flow chart showing an operation for carrying out recovery when a recording head is not capped in the second embodiment of the present invention.
Figure 9:
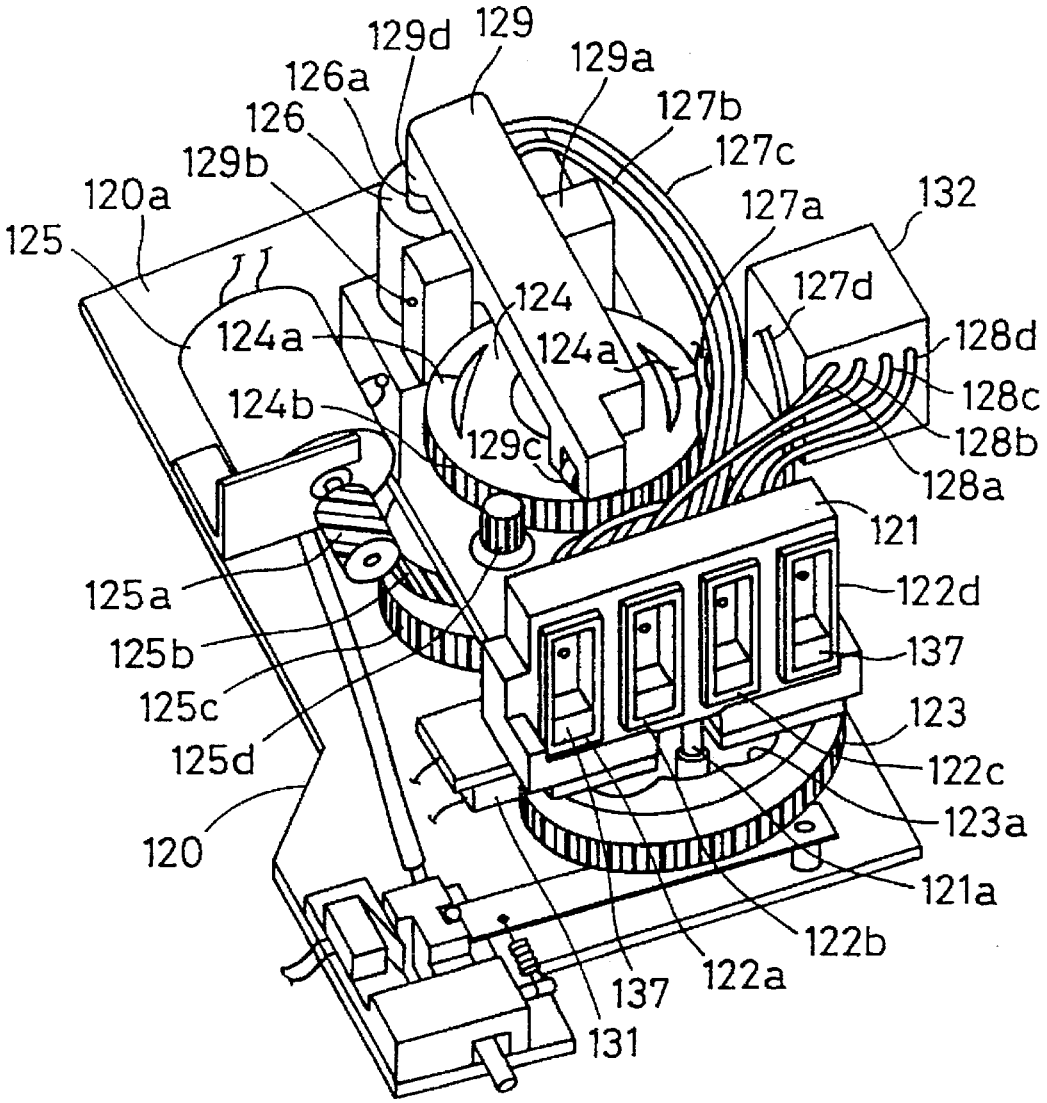
FIG.9 PRIOR ART
FIG. 9 is a perspective view showing a cap mechanism part of a conventional ink jet recorder.
Figure 10:
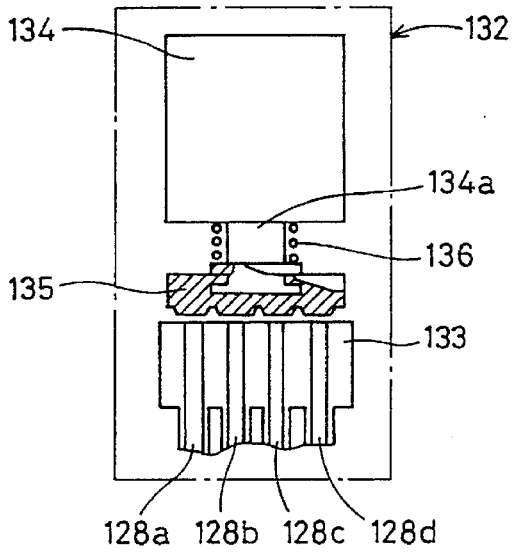
FIG.10 PRIOR ART
FIG. 10 is an enlarged view showing an electromagnetic valve part in FIG. 9.
Figure 11:
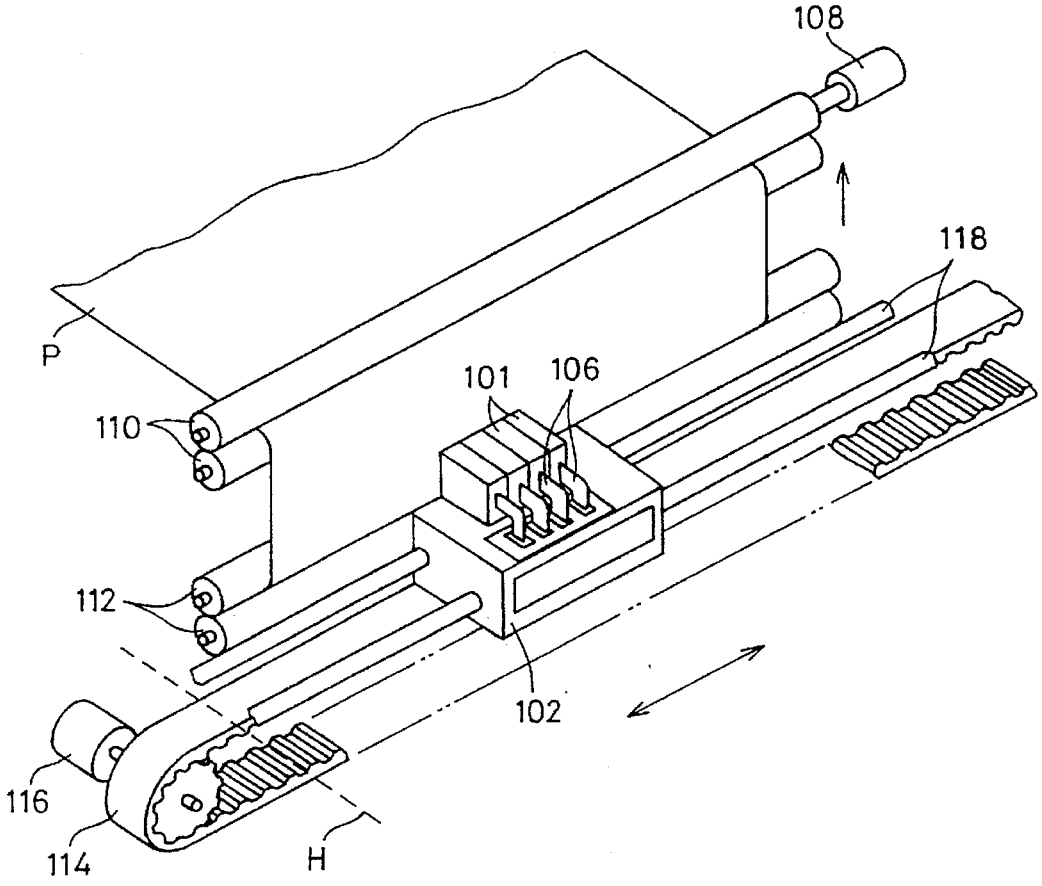
FIG.11 PRIOR ART
FIG. 11 is a block diagram showing a principal part of the conventional ink jet recorder.

FIGS. 7 and 8 are flow charts of an operation for capping the head 2 in a non-printing state and an operation for recovering the head 2 when the same is uncapped respectively.

Referring to FIG. 7, the interior of the negative pressure tank 17 is maintained at a negative pressure (S71), and a determination is made as to whether or not a recording signal is received (S72). Recording is continued if a recording signal is inputted (S79), while the head 2 is automatically capped if no recording signal is inputted. First, the carriage 3 is moved to the cap position, which in turn is detected by the sensor 21 (S73), for starting movement of the cap 1 toward the head 2 (S74). A position of the cap 1 is detected by the sensor 24 immediately before the same comes into contact with the ink jet surface of the head 2, and the valve 18 mounted on the cap side pipe 8 of the negative pressure tank 17 which is maintained at the negative pressure is opened (S75). In this state, a step signal is fed to the motor 23 for bringing the cap 1 into close contact with the surface of the head 2, the angle of rotation is controlled, and capping is completed (S76). Immediately after this step, the valve 18 of the negative pressure tank 17 is closed by driving a timer after the sensor 24 detects the position of the cap 1 immediately before the contact with the head 2 and stopping the valve 18 of the negative pressure tank 17 immediately after the contact, and a sucking operation is completed to complete an ordinary capping operation (S77). Thereafter the suction pump is driven to maintain the interior of the negative pressure tank 17 at the negative pressure (S78).

Referring to FIG. 8, on the other hand, the interior of the negative pressure tank 17 is maintained at the negative pressure (S81), and a determination is made as to whether or not a maintenance signal is received (S82), in order to recover the head 2 when the same is uncapped. If no maintenance signal is received, the process enters a wait state (S83). If a maintenance signal is received, on the other hand, the carriage 3 is first moved to the cap position, which in turn is detected by the sensor 21 (S84), and movement of the cap 1 toward the head 2 is started (S85). A position of the cap 1 is detected by the sensor 24 immediately before the same comes into contact with the ink jet surface of the head 2, and the valve 18 mounted on the cap side pipe 8 of the negative pressure tank 17 is opened (S86). In this state, a step signal is fed to the motor 23 for bringing the cap 1 into close contact with the surface of the head 2, the angle of rotation is controlled, and capping is completed (S81). The valve 18 is kept open also after this step to carry out a sucking operation and the suction pump is similarly driven to maintain the interior of the negative pressure tank 17 at the negative pressure, while unnecessary ink is discharged into the waste liquid tank 12. In this case, the suction is enabled for a longer time than that in a suction mechanism provided only with a pump since the sucking operation is carried out by the negative pressure tank 17, whereby a reliable recovery operation is enabled. The valve 18 of the negative pressure tank 17 is closed after a lapse of a constant time by driving the timer after the sensor 24 detects the position of the cap 1 immediately before the contact with the head 2 and stopping the valve 18 of the negative pressure tank 17 immediately after the contact, and a maintenance operation is completed (S88). Thereafter the suction pump is driven to maintain the interior of the negative pressure tank 17 at the negative pressure (S89).

According to the ink jet recorder of the second embodiment, as hereinabove described, it is possible to reliably prevent air from being forced into the ink jet nozzle of the head and to reliably bring the cap into close contact with the ink jet surface of the head in a non-printing state and in a capping operation following forcible ink suction, thereby enabling a further reliable recovery operation as compared with the first embodiment. Further, it is also possible to reliably prevent the ink jet surface of the head from drying.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet recorder comprising:

a recording head portion having a jet nozzle for jetting ink; and sealing means for sealing said jet nozzle, thereby preventing evaporation of water being contained in said ink in said jet nozzle and an ink passage communicating with said jet nozzle, said sealing means including:

a cap portion being formed by an elastic body for sealing said jet nozzle said cap portion including an interior, and suction means for starting suction of the interior of said cap portion immediately before said cap portion comes into contact with said recording head portion, so that air is prevented from entering the jet nozzle.

2. The ink jet recorder in accordance with claim 1, wherein said suction means further includes;

a negative pressure tank communicating with said cap portion and generally maintaining a negative pressure state, and a switching valve being provided between said cap portion and said negative pressure tank, said suction means opening said switching valve immediately before said cap portion comes into contact with said recording head portion for starting said suction of the interior of said cap portion by said negative tank, said cap portion contacting said recording head portion to seal said jet nozzle, and means for closing said switching valve upon completing said suction of the interior of said cap portion by said negative pressure tank.

3. The ink jet recorder in accordance with claim 2, wherein said suction means further includes a piston and a cylinder for bringing the interior of said negative pressure tank into a negative pressure state, said suction means carrying out said suction of the interior of said cap portion by said piston and said cylinder in a state opening said switching valve up to a lapse of a prescribed time after sealing said jet nozzle with said cap portion.

4. The ink jet recorder in accordance with claim 3, wherein said suction means further includes:

moving means for moving said cap portion toward said jet nozzle, detection means for detecting that said cap portion is moved by said moving means and positioned immediately in front of said jet nozzle, and timer means for detecting a lapse of a prescribed time after said detection means detects that said cap portion is positioned immediately in front of said jet nozzle, said suction means closing said switching valve when said timer means detects said lapse of said prescribed time.

5. The ink jet recorder in accordance with claim 4, wherein said suction means maintains the interior of said negative pressure tank in a negative pressure state by said piston and said cylinder after said switching valve is closed in response to a result of detection by said timer means.

6. The ink jet recorder in accordance with claim 1, wherein said suction means includes:

suction pump means being formed by a piston and a cylinder, and a one-way valve being provided between said cap portion and said suction pump means, said suction means stopping an operation of said suction pump means after said cap portion seals said jet nozzle, for completing said suction of the interior of said cap portion.

7. The ink jet recorder in accordance with claim 6, wherein said suction means further includes;

moving means for moving said cap portion toward said jet nozzle, detection means for detecting that said cap portion is moved by said moving means and positioned immediately in front of said jet nozzle, and timer means for detecting a lapse of prescribed time after said detection means detects that said cap portion is positioned immediately in front of said jet nozzle, said suction means stopping a suction operation when said timer means detects said lapse of said prescribed time.

8. The ink jet recorder in accordance with claim 1, wherein said sealing means seals said jet nozzle with said cap portion when said recording head carries out no printing operation.

9. The ink jet recorder in accordance with claim 8, wherein said sealing means decides that said recording head carries out no printing operation when the sealing means receives no recording signal.

10. The ink jet recorder in accordance with claim 1, wherein said sealing means executes a head recovery operation in response to a maintenance signal indicating said head recovery operation.

11. The ink jet recorder in accordance with claim 1, further including:

moving means for moving said recording head portion, and detection means for detecting that said recording head portion is moved by said moving means and located on a prescribed position, said sealing means sealing said jet nozzle with said cap portion when said detection means detects location of said recording head portion on said prescribed position.

* * * * *